United States Patent [19]

DiMatteo et al.

[11] Patent Number: 4,787,107

[45] Date of Patent: Nov. 29, 1988

[54] BLANKET REMOVER ARRANGEMENT

[75] Inventors: Paul DiMatteo, Dix Hills; Charles F. Chubb, Brookville, both of N.Y.

[73] Assignee: Nova Technologies, Inc., Hauppauge, N.Y.

[21] Appl. No.: 43,182

[22] Filed: Apr. 27, 1987

Related U.S. Application Data

[63] Continuation-in-part of Ser. No. 731,533, May 7, 1985.

[51] Int. Cl.[4] ..... A47C 21/02

[52] U.S. Cl. ..... 5/488; 5/504; 5/506

[58] Field of Search ..... 5/460, 488, 498, 504–506

[56] References Cited

U.S. PATENT DOCUMENTS

| | | | |
|---|---|---|---|
| 323,265 | 7/1885 | Bohaker | 5/505 |
| 378,220 | 2/1888 | Staples et al. | 5/81 B |
| 427,533 | 5/1890 | Arnold | 5/488 |
| 716,886 | 12/1902 | Goode | 5/81 B |
| 3,855,655 | 12/1974 | Propst | 5/488 |
| 4,644,599 | 2/1987 | Wolcott | 5/505 X |

FOREIGN PATENT DOCUMENTS

| | | | |
|---|---|---|---|
| 649439 | 10/1962 | Canada | 5/488 |

*Primary Examiner*—Gary L. Smith
*Assistant Examiner*—Michael F. Trettel
*Attorney, Agent, or Firm*—Max Fogiel

[57] ABSTRACT

An arrangement for removing a blanket from a bed to clear the bed for transferring a person. The person lies on a transport sheet, and a cover sheet extends across and above the transport sheet and person. The cover sheet is removably fastened to a lift member in vicinity of a side of the bed. The lift member is operated by a motor to remove the cover sheet. The motor is controllable to remove or replace the cover sheet.

9 Claims, 5 Drawing Sheets

BLANKET REMOVER ARRANGEMENT

The present application is a continuation-in-part of the parent application Ser. No. 731,533, filed May 7, 1985.

BACKGROUND OF THE INVENTION

The parent application describes methods by which a person can be transferred from a bed to a wheelchair. In order for this to be done, any sheet or blanket over the patient must first be removed, either manually or with the aid of a mechanism. Many patients are so disabled that they cannot themselves manually remove or replace blankets and so would be unable to make use of automatic transfer equipment without the help of an attendant.

SUMMARY OF THE INVENTION

Accordingly, it is the primary object of the present invention to provide an arrangement for removing a sheet or blanket from over a person resting on a bed, so that the person can be transferred off the bed and onto a wheelchair.

Another object of the invention is to provide an arrangement whereby a patient himself can, by actuating a motor, cause a sheet or blanket to be removed from the bed, for freeing the patient to be transferred off the bed, or for reasons of comfort.

Additional objects and advantages of the present invention will become evident from the following description of specific embodiments when read in connection with the accompanying drawings.

It is to be understood that the term "blanket", as used herein, is to include cover sheets, spreads and other like coverings which may be used over a person on a bed.

DESCRIPTION OF THE PREFERRED EMBODIMENTS

Figures 1, 1A:
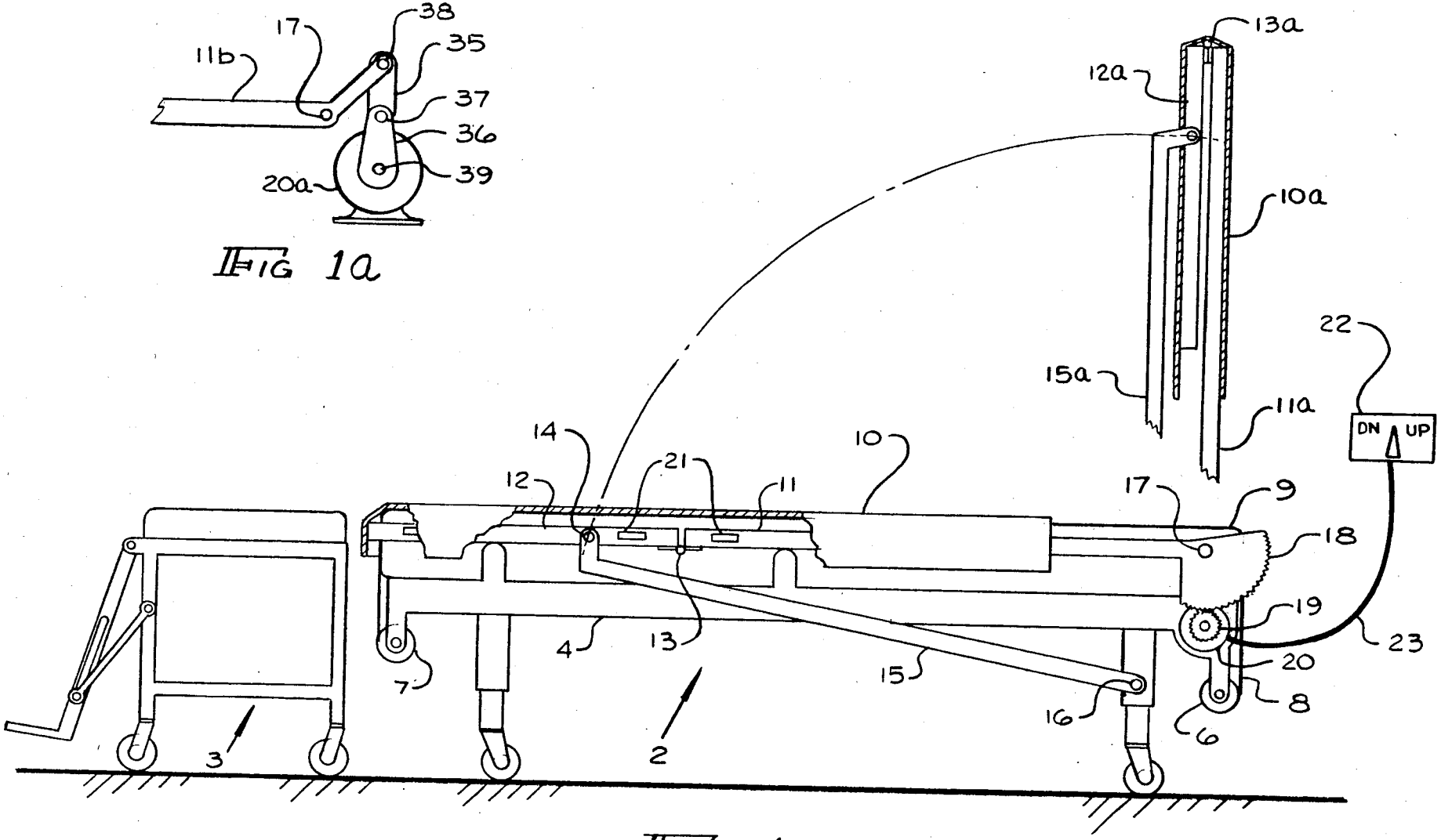
FIG. 1 is a side view of a wheelchair, and a bed having a transport sheet, and shows an arrangement for lifting and folding a blanket.
FIG. 1*a* is a schematic view of a bell crank drive arrangement.

FIG. 1 shows a side view of a person transfer system including a bed with an arrangement for raising the blanket from over a person so that the person can be transferred to a wheelchair, or for any other purpose.

A wheelchair 3 with its back rest removed, or another convenient platform, is positioned at the foot of a bed 2, ready to receive a person to be transferred from the bed. The bed 2 has a frame 4 and a mattress 9. A transfer sheet 8 extends over the mattress between two rollers 6 and 7 at the head and foot ends of the bed, respectively.

The transfer sheet 8 is attached to a partially wound up on the rollers 6 and 7, which are coupled to sheet drive motors, not shown. By actuating a motor, the transfer sheet 8 can be moved across the mattress 9 so as to transport a person lying on the sheet across the bed and onto the wheelchair 3, as described in the parent application. Preferably, the bed 2 also has a lifting arrangement, which is not shown, for lifting the person to a sitting position on the wheelchair.

The bed 2 has a blanket 10 extending over the mattress and over lift bars 11 and 12 on each side of the bed. The blanket 10 is partially cut away to show the lift bars 11 and 12 in their lowered positions, resting on the frame 4. The blanket 10 is removably attached to the lift bars by means of fastening strips of touch-and-close pull-and-release material 21, commonly available under the trade name VELCRO; alternatively, other fasteners may be used.

Lift bars 11 and 12 are connected by hinges 13. The lift bar 11 is connected to the frame 4 through a pivot 17. The lift bar 12 is connected through a pivot 14 to a link 15 which is connected to the bed frame 4 through a pivot 16. The lift bars 11 and 12, and link 15, and frame 4*a* comprise 4-bar linkages on each side of the bed.

The lift bar 12 has a sector gear 18 driven through a pinion 19 on the motor 20, which is connected through cable 23 to a control switch 22. With the control switch in the "UP" position, the motor 20 drives the sector gear 18 clockwise so as to raise the lift arm 11 to an elevated position 11*a*. The lift bar 12 and link 15 are pulled up through hinge 13 to positions 12*a*, 15*a* and 13*a*, respectively. The blanket is thereby raised to a folded position 10*a*, off the mattress 9. Rotating the switch to "DN" reverses the motor to replace the blanket on the bed.

FIG. 1*a* shows an alternative drive arrangement using a bell crank coupling instead of gears between the lift arm and the motor. In this arrangement, the lift arm 11 is replaced with a lift arm 11*b*, which is coupled through a pivot 38, a link 35 and a pivot 37, to an arm 36 attached to the output shaft 39 of a motor 20*a*. It is to be understood that the motor 20*a* may include gears to obtain the desired output shaft speed. Rotation of the motor output shaft 39 moves the lift arm 11*b* cyclically between its lowered and raised positions, so that actuating the motor 20*a* in one direction both removes and replaces the blanket on the bed. It is to be understood that other types of oscillating drives, which are well known in the art, also can be used in place of a bell crank.

Figure 2:
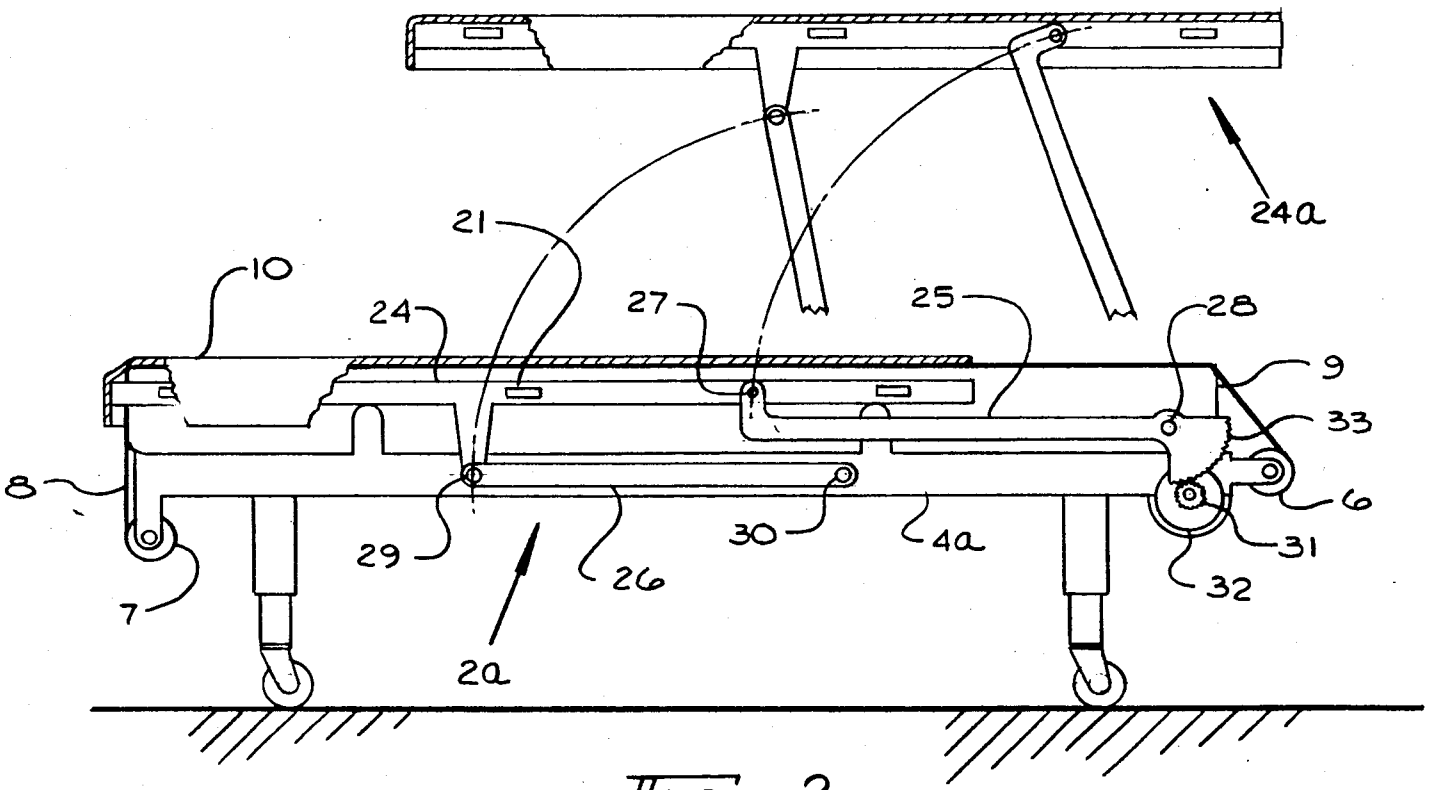
FIG. 2 is a side view of a bed and shows a different arrangement for removing a blanket.

FIG. 2 is a side view of a bed for a person transfer system, showing a different arrangement for lifting the blanket. The bed 2*a* has a transport sheet 8 extending across the mattress 9 between two transport drive rollers 6 and 7. A blanket 10 extends over the transport sheet and is removably fastened through attachment strips 21 to lift bars 24 on opposite sides of the bed. The lift bars 24 in their lowered positions rest on the frame 4*a* of the bed. The lift bars are pivotally connected to the frame 4*a* through links 25 and 26 and pivots 27, 28, 29, and 30, comprising 4-bar linkages. The link 25 has a sector gear 33 which is driven by a motor 32 through a pinion 31 on each side of the bed. Actuating the motor 32 rotates the link 25 about the pivot 28, and raises the lift bar 24 and the blanket 10 attached thereto to an elevated position 24*a*. Alternatively, as is well known in the art, the lengths of links 25 and 26 and locations of pivot points 27, 28, 29, and 30 can be selected differently so that, when elevated, the lift bars 24 will be inclined, instead of being substantially level. A similar arrangement uses an oscillating drive as shown in FIG. 1*a*, in place of the pinion 31 and sector gear 33.

Figure 4:
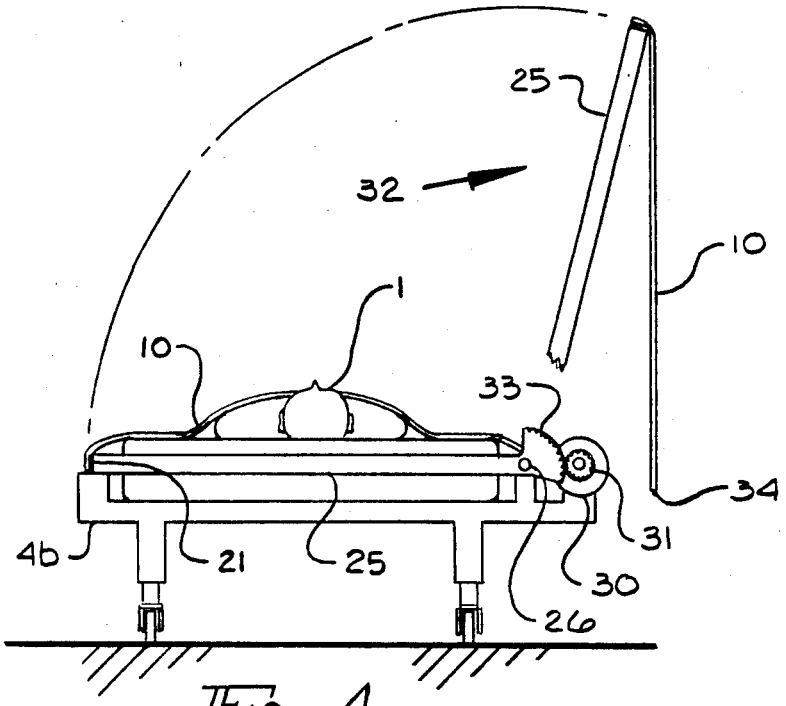
FIG. 4 is an end view of the bed in FIG. 3, and shows the pivoted member lowered and raised.
Figure 3:
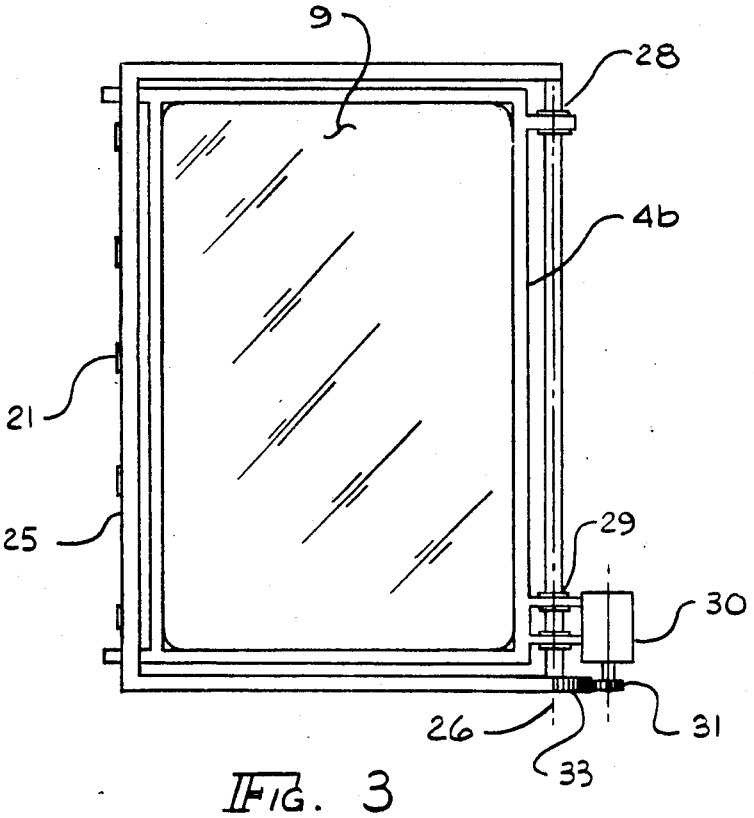
FIG. 3 is a top view of a bed for transferring a person and using a pivoted member for removing a blanket.

FIG. 3 is a top view of a bed for use in a person transfer system, showing another arrangement for lifting a blanket. FIG. 4 is a view toward the head end of this bed, and shows a person covered by a blanket. For reasons of clarity, a transport sheet and rollers are not shown in FIGS. 3 and 4, but it is to be understood that the bed can have a transport sheet, rollers and a mechanism for lifting a person to a sitting position on a wheelchair. The blanket lifting arrangement can fit freely around and above the bed that is so equipped.

FIG. 3 shows a bed with a bed frame 4*b* supporting a mattress 9. A lift frame 25 for raising a blanket extends around the mattress and is pivotally mounted to the bed frame on bearings 28 and 29 so that it is rotatable about an axis 26. On the opposite side of the bed, the lift frame 25, shown in its lowered position, rests on the bed frame 4*b*. A sector gear 33 is attached to the lift frame 25 and engages a pinion 31 on a motor 30. The lift frame has attachment strips 21 for attaching a blanket. Alternatively, other methods of attachment can be used, or a 3-sided frame can be used with the blanket attached to the two outer sides.

FIG. 4 shows an end view of the bed with a person 1 covered by a blanket 10, which is attached to the lift frame 4*b* by attachment strips 21. Actuating the motor 30, which is mounted on the frame 4*b*, rotates the sector gear 33 through the pinion 31 thereby lifting the lift frame 25 and the attached blanket 10 from a position covering the person 1 to an upper position 32, removed from the bed. A similar arrangement uses a bell crank, or other type of oscillating drive, as shown in FIG. 1*a*, in place of the pinion 31 and sector gear 33. The edge 34 of the blanket 10 may be free, as shown, or alternatively, may be attached to the frame 4*b*, or to the lift frame 25, or to an articulated frame in a hospital type bed.

It is to be understood that in the arrangements shown in FIGS. 1, 2, 3, and 4, the blanket can be attached loosely to the lift bars or lift frame, with sufficient slack to allow the head end or the foot end of the mattress in a hospital type of bed to be raised.

Figure 5A:
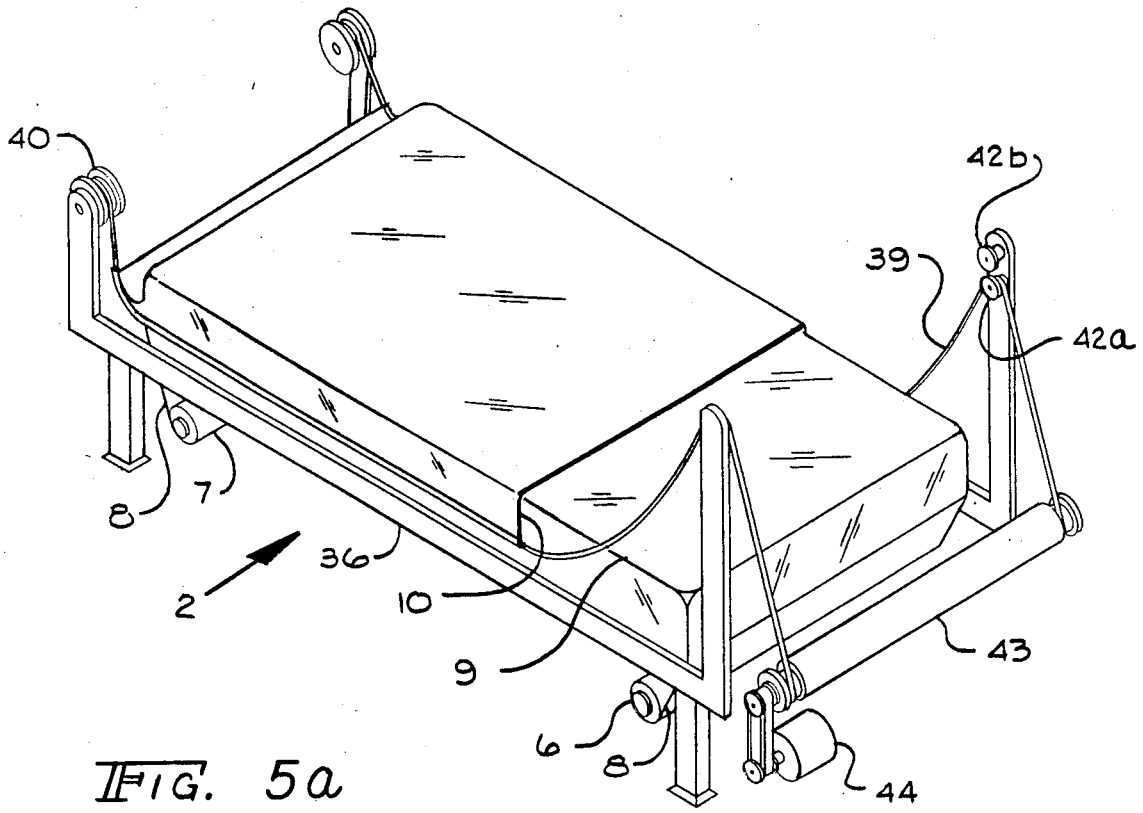
FIG. 5*a* is a perspective view of a bed showing another arrangement for removing a blanket.
Figure 5B:
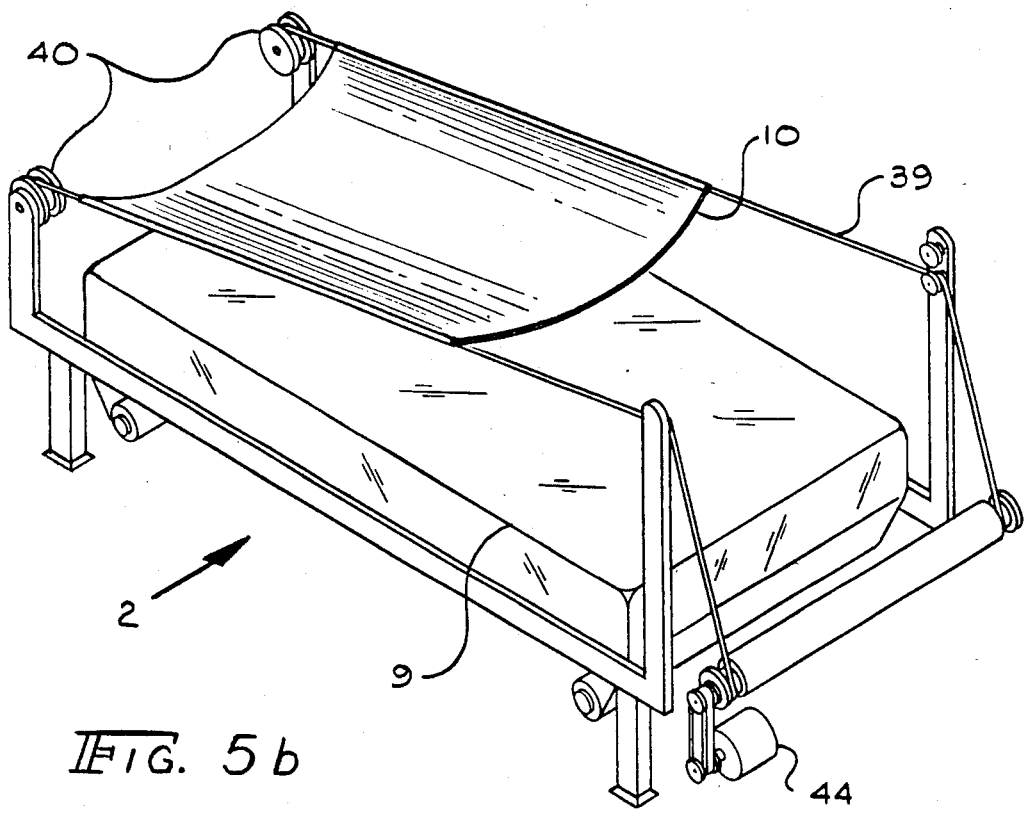
FIGS. 5*b* and 5*c* show the arrangement of FIG. 5*a* with the blanket partially and fully removed, respectively.
Figure 5C:
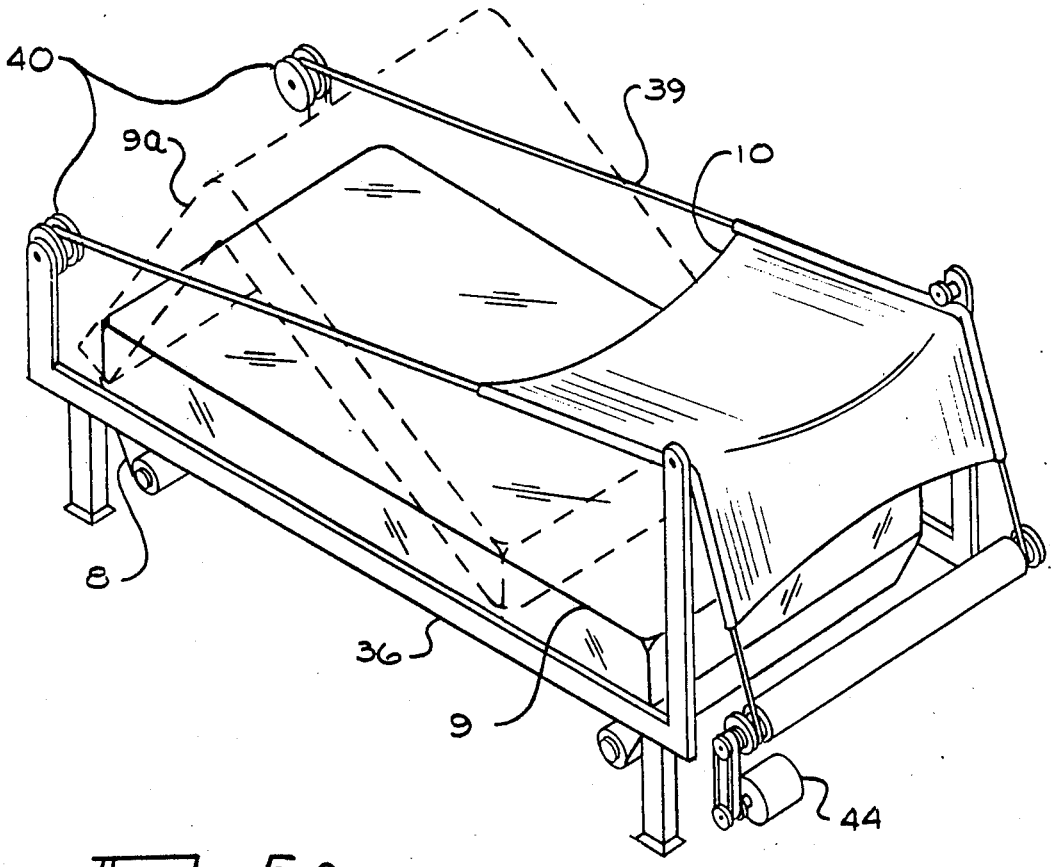

FIG. 5*a*, 5*b* and 5*c* show another arrangement for removing a blanket so that a person can be transferred off a bed.

FIG. 5*a* shows a bed 2 having a blanket 10 across a mattress 9. A transport sheet 8 extends across the mattress and is partially wound at opposite ends of the bed on sheet drive rollers 6 and 7 which can be driven to move the transport sheet and a person thereon across the bed. The blanket 10 is attached along two opposite edges to cables 39, which are partially wound on spring-driven rollers 40 at the foot end of the bed. At the head end of the bed each cable passes between two guidance rollers 42*a* and 42*b* to a wind-up roller 43, which is coupled to a drive motor 44. The guidance rollers 42*a* and 42*b*, which are mounted to a frame 36 on the bed 2 are shaped to rollably support the cable 39. The guidance rollers have a gap between them through which the edge of the blanket 10 can pass. The gap is sufficiently narrow to prevent the cable from escaping from between the rollers. The motor 44 can be energized to wind up the cables 39 on the roller 43, thereby lifting the blanket 10.

FIG. 5*b* shows the blanket 10 lifted above the mattress 9 with the cables 39 tightened by action of the motor 44. Preloaded springs in rollers 40 hold these rollers from unwinding until the tension in the cables 39 is increased beyond a predetermined value.

FIG. 5*c* shows the blanket 10 moved to its lifted position by action of the motor 44, which is then stopped. The springs in rollers 40 maintain tension in the cables 39 to support the blanket. With the blanket lifted, the transport sheet 8 is free for moving a person thereon to the end of the bed and part way onto a wheelchair (not shown). The person can then be raised to a sitting position on the wheelchair by raising the mattress 9, by means not shown here, to a position 9*a*, shown with dashed lines. Mattress 9 passes between the cables 39 without interference.

When the mattress 9 is in the normal lowered position, the blanket can be returned to its lowered position over the mattress by energizing the motor 44 in the reverse direction. The cables 39 then unwind from the roller 43 and are rewound on rollers 40 by their internal springs until the blanket reaches the position shown in FIG. 5*b*. The rollers 40 are then fully wound, and continued rotation of the motor 44 lowers the blanket to its normal position, covering the mattress 9, as shown in FIG. 5*a*.

Figure 5D:
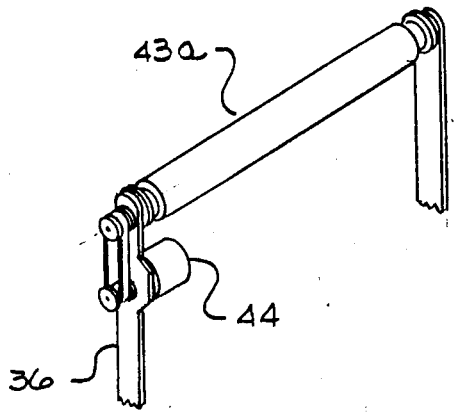
FIG. 5*d* is a partial perspective view of a similar arrangement which has a roller mounted at the top of a frame.

FIG. 5*d* shows as part of an alternative arrangement a motor 44 driving a single wind-up roller 43*a*, which is mounted on the frame 36 in place of the two sets of guidance rollers 42 and 43*a*, shown in FIGS. 5*a* through 5*c*. The roller 43*a* in FIG. 5*d* operates in the same manner as the roller 43 in FIG. 5*a*, except that the blanket 10 is wound on the roller 43*a* instead of passing between the guidance rollers as shown in FIG. 5*c*. The roller 43 can be shorter than the roller 43*a* which extends the width of the blanket 10.

We claim:

1. A person transfer system including a platform positioned at a side of a bed and having a horizontal surface; a bed with a frame and a mattress thereon; a transport sheet on which a person may lie; said transport sheet extending across said mattress; roller means for moving said transport sheet and transporting said person across the mattress and onto said horizontal surface; a cover sheet extending across the mattress over and on said transport sheet; a lift member and attachment means, said cover sheet being removably fastened by said attachment means to said lift member in vicinity of a side of said bed; motor means for moving said lift member to remove said cover sheet from said transport sheet; control means for actuating said motor means to remove or replace said cover sheet; said lift member comprising a first bar and a second bar on each side of said bed; a hinge for pivotally connecting said first and second bars; said first bar being pivotally connected to said frame; said motor means being coupled to said first bar; a link pivotally connected to said second bar, said link being pivotally connected to said frame; said first and second bars and said link and said frame comprising a four bar linkage on each side of said bed so that actuating said motor raises said first and second bars to substantially vertical position above said bed; said bars and said cover sheet attached thereto being folded above said bed; said motor replacing said cover sheet on said mattress when said motor is actuated therefor.

2. An invalid transfer system as defined in claim 1, wherein said cover sheet is a blanket.

3. An invalid transfer system as defined in claim 1, wherein said attachment means comprises touch-and-close, pull-and-release material such as that available under the trade name VELCRO.

4. An invalid transfer system as defined in claim 1, wherein said platform is a wheelchair.

5. An invalid transfer system as defined in claim 1, including a sector gear coupled to said lift member; said motor means comprising a motor having a pinion engaging and driving said sector gear; said motor being reversible to replace said cover sheet on said bed.

6. An invalid transfer system as defined in claim 1, wherein said motor means comprises a motor coupled through oscillating drive means to said lift member so that actuating said motor in one direction moves said lift member to alternately remove and replace said cover sheet.

7. A bed with a frame and a mattress; a cover sheet extending across said mattress; a first bar and a second bar on each side of said bed; a hinge connecting pivotally said first and second bars, said cover sheet being removably attached to said first and second bars; said first bar being pivotally connected to said frame; a motor coupled to said first bar; a link connected pivotally to said second bar, said link being pivotally connected to said frame; said first and second bars and said link and said frame comprising a four-bar linkage on each side of said bed so that actuating said motor raises said first and second bars to a substantially vertical position above said bed; said bars and said cover sheet attached thereto being folded above said bed; said motor replacing said cover sheet on said bed when said motor is actuated therefor.

8. A person transfer system including a platform positioned at a side of a bed and having a horizontal surface; a bed with a frame and a mattress thereon; a transport sheet on which a person may lie; said transport sheet extending across said mattress; roller means for moving said transport sheet and transporting said person across the mattress and onto said horizontal surface; a cover sheet extending across the mattress over and on said transport sheet; a lift member and attachment means, said cover sheet being removably fastened by said attachment means to said lift member in vicinity of a side of said bed; motor means for moving said lift member to remove said cover sheet from said transport sheet; control means for actuating said motor means to remove or replace said cover sheet; said lift member comprising cables along opposite sides of said bed; first rollers mounted above the foot end of said bed; springs acting on said first rollers, said cables being wound at one end by said springs; a second roller, said cables passing above the head of said bed and being attached at their other end to said second roller; said second roller being coupled to said motor means; said cover sheet being lifted and removed from said mattress by winding said cables on said second roller by said motor means.

9. A person transfer system including a platform positioned at a side of a bed and having a horizontal surface; a bed with a frame and a mattress thereon; a transport sheet on which a person may lie; said transport sheet extending across said mattress; roller means for moving said transport sheet and transporting said person across the mattress and onto said horizontal surface; a cover sheet extending across the mattress over and on said transport sheet; a lift member and attachment means, said cover sheet being removably fastened by said attachment means to said lift member in vicinity of a side of said bed; motor means for moving said lift member to remove said cover sheet from said transport sheet; control means for actuating said motor means to remove or replace said cover sheet; said lift member comprising cables along opposite sides of said bed; first rollers mounted above the foot end of said bed; springs acting on said first rollers, said cables being wound at one end by said springs; a second roller, said cables being attached at their other end to said second roller above the head end of said bed; said second roller being coupled to said motor means; said cover sheet being lifted and removed from said mattress by winding said cables on said second roller by said motor means.

* * * * *